US010796629B2

(12) United States Patent
Omid-Zohoor et al.

(10) Patent No.: US 10,796,629 B2
(45) Date of Patent: Oct. 6, 2020

(54) DISPLAY PANEL VOLTAGE DROP CORRECTION

(71) Applicant: APPLE INC., Cupertino, CA (US)

(72) Inventors: Kasra Omid-Zohoor, Sunnyvale, CA (US); Marc J. DeVincentis, Palo Alto, CA (US); Paolo Sacchetto, Cupertino, CA (US); Sinan Alousi, Campbell, CA (US); Yafei Bi, Los Alto Hills, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/181,212

(22) Filed: Nov. 5, 2018

(65) Prior Publication Data

US 2020/0043402 A1 Feb. 6, 2020

Related U.S. Application Data

(60) Provisional application No. 62/712,623, filed on Jul. 31, 2018.

(51) Int. Cl.

| | |
|---|---|
| ***G09G 3/32*** | (2016.01) |
| ***G09G 3/3225*** | (2016.01) |
| ***G09G 3/36*** | (2006.01) |

(52) U.S. Cl.

CPC ..... *G09G 3/32* (2013.01); *G09G 3/3225* (2013.01); *G09G 3/3648* (2013.01); *G09G 2310/0297* (2013.01); *G09G 2320/0233* (2013.01); *G09G 2320/0242* (2013.01); *G09G 2330/021* (2013.01); *G09G 2330/12* (2013.01); *G09G 2360/16* (2013.01)

(58) Field of Classification Search

CPC ..... G09G 3/30–38; G09G 2320/0242; G09G 2320/0233; G09G 2320/12; G09G 2360/16

See application file for complete search history.

(56) References Cited

U.S. PATENT DOCUMENTS

| | | | | |
|---|---|---|---|---|
| 8,232,987 | B2 | 7/2012 | Park et al. | |
| 2013/0162697 | A1* | 6/2013 | Kobayashi | G09G 3/3648 345/690 |
| 2017/0148369 | A1* | 5/2017 | Park | G09G 3/2007 |
| 2018/0061321 | A1* | 3/2018 | Hong | G09G 3/3241 |
| 2018/0336808 | A1* | 11/2018 | Lee | G09G 3/006 |

* cited by examiner

*Primary Examiner* — Laurence J Lee

(74) *Attorney, Agent, or Firm* — Kilpatrick Townsend & Stockton LLP

(57) ABSTRACT

A flat-panel display device and method to compensate for a voltage drop by supply voltage in the flat-panel display.

20 Claims, 6 Drawing Sheets

DISPLAY PANEL VOLTAGE DROP CORRECTION

RELATED APPLICATIONS

This application claims priority to U.S. Provisional Patent Application Ser. No. 62/712,623, filed Jul. 31, 2018, which is hereby incorporated by reference in its entirety for all purposes.

BACKGROUND

Field

Aspects of the disclosure relate in general to flat-panel displays. Aspects include a method and device to compensate for a voltage drop by an electroluminescence voltage supply in a flat-panel display.

Description of the Related Art

Displays are electronic viewing technologies used to enable people to see content, such as still images, moving images, text, or other visual material.

A flat-panel display includes a display panel including a plurality of pixels arranged in a matrix format. The display panel includes a plurality of scan lines formed in a row direction (y-axis) and a plurality of data lines formed in a column direction (x-axis). The plurality of scan lines and the plurality of data lines are arranged to cross each other. Each pixel is driven by a scan signal and a data signal supplied from its corresponding scan line and data line.

Flat-panel displays can be classified as passive matrix type light emitting display devices or active matrix type light emitting display devices. Active matrix panels selectively light every unit pixel. Active matrix panels are used due to their resolution, contrast, and operation speed characteristics.

One type of active matrix display is an active matrix organic light emitting diode (AMOLED) display. The active matrix organic light emitting display produces an image by causing a current to flow to an organic light emitting diode to produce light. The organic light emitting diode is a light-emitting element in a pixel. The driving thin film transistor (TFT) of each pixel causes a current to flow in accordance with the gradation of image data.

The luminance uniformity of AMOLED displays is degraded when there is a voltage drop ("IR drop") by the electroluminescence voltage supply ("ELVDD," also referred to as a "pixel voltage supply").

Flat-panel displays are used in many portable devices such as laptops, mobile phones, smartphones, tablet computers, and other digital devices.

SUMMARY

Embodiments include an electronic display designed to compensate for a voltage drop by supply voltage in the electronic display.

In one embodiment, an electronic display comprises a display panel, a power management integrated circuit (PMIC), and a display driver integrated circuit. The display panel is configured to receive a pixel data voltage. The power management integrated circuit is configured to supply an electroluminescence voltage to the display panel. The display driver integrated circuit includes a correction circuit. The correction circuit is configured to sense the electroluminescence voltage supplied to the display panel, to calculate a voltage drop from the electroluminescence voltage and an expected supply voltage, and to correct the display voltage to match the voltage drop. A variation of the electronic display includes the electronic display wherein the correction circuit is further configured to sense the electroluminescence voltage supplied to the display panel at multiple locations across the display panel, to calculate voltage drop from the electroluminescence voltage and an expected supply voltage, and to correct the display voltage to match the voltage drop at multiple locations across the display panel.

In another embodiment, an electronic display comprises a display panel, a display driver integrated circuit, and a power management integrated circuit (PMIC). The display driver integrated circuit includes a correction circuit. The correction circuit is configured to sense an electroluminescence voltage supplied to the display panel, to calculate voltage drop from the electroluminescence voltage and an expected supply voltage, and to calculate an electroluminescence voltage distortion based on the voltage drop. The power management integrated circuit (PMIC) is configured to receive the electroluminescence voltage distortion from the display driver integrated circuit and to supply a predistorted electroluminescence voltage to the display panel based on the electroluminescence voltage distortion.

In yet another embodiment of the disclosure, an electronic display comprises a display panel, a power management integrated circuit (PMIC), a calculator, and a display driver integrated circuit. The display panel is configured to receive a display voltage. The power management integrated circuit is configured to supply an electroluminescence voltage (ELVDD) to the display panel. The calculator is configured to calculate an average pixel luminance of a current image frame supplied to the display panel and a previous image frame supplied to the display panel. The display driver integrated circuit has a correction circuit. The correction circuit is configured to receive the average pixel luminance from the calculator, and to correct the display voltage based on the average pixel luminance.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evident to the contrary from the description, where elements in different figures use identical reference numbers, the elements are generally either identical or at least similar in function or purpose.

DETAILED DESCRIPTION

Aspects of the disclosure include the observation that in a flat-panel display, there may be a global color and luminance non-uniformity. In particular, the color and luminance non-uniformity manifests itself as a color shift with luminosity decreasing across the y-axis of a display panel. Instead of a uniform color from top-to-bottom of the display panel (across the y-axis, i.e. rows), color may shift from a bright greenish tint to a dark reddish tint. The problem may be more prominent and more severe as the panel size of the flat-panel display increases.

Figure 1:
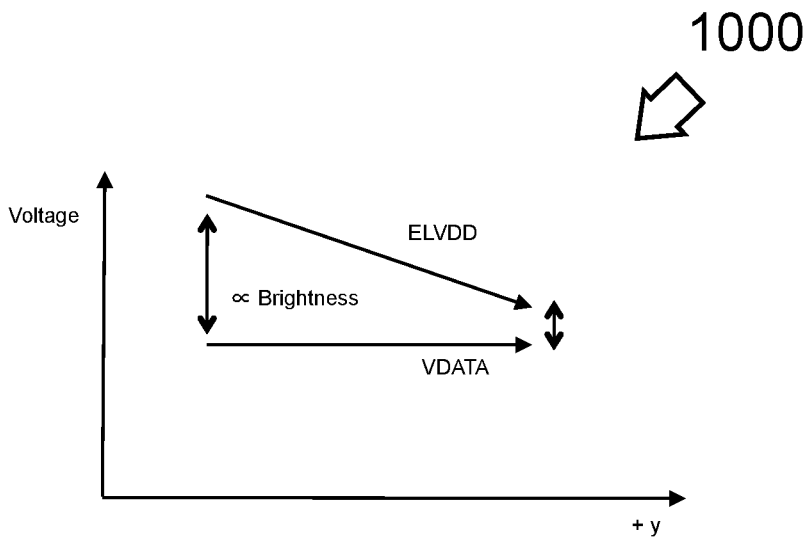
FIG. 1 illustrates the voltage drop of electroluminescence voltage and constant pixel data voltage across a conventional flat-panel display, with a corresponding brightness drop by the flat-panel display.

One aspect of the disclosure includes the understanding that the color shift and decreasing luminosity of the display panel is caused by a voltage drop of an electroluminescence voltage supply (ELVDD) to the display panel, while the pixel data voltage (VDATA) remains constant. FIG. 1 is a depicting a problem 1000 caused by a voltage drop of electroluminescence voltage and constant pixel data voltage across a y-axis of a conventional flat-panel display, with a corresponding brightness drop of a flat-panel display.

Another aspect of the disclosure includes the realization that the voltage drop by the electroluminescence voltage supply can be compensated by correcting the pixel data voltage to mirror the ELVDD drop, or anticipating the ELVDD drop and correcting the expected ELVDD drop by predistorting the ELVDD voltage signal.

In order to better appreciate the features and aspects of the present disclosure, further context for the disclosure is provided in the following section by discussing several implementations of a flat-panel display that includes address a voltage drop by an electroluminescence voltage supply according to embodiments of the disclosure. These embodiments are for explanatory purposes only and other embodiments may be employed in other display devices. For example, embodiments of the disclosure can be used with any display device that compensates for electroluminescence voltage supply drop.

Figure 2:
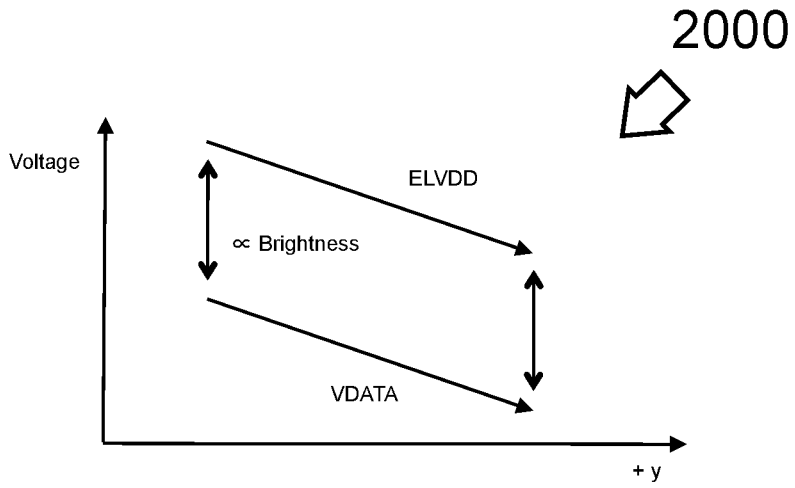
FIG. 2 depicts a method of compensating for an electroluminescence voltage drop across a flat-panel display, by changing pixel data voltage to maintain the display brightness.
Figure 3:
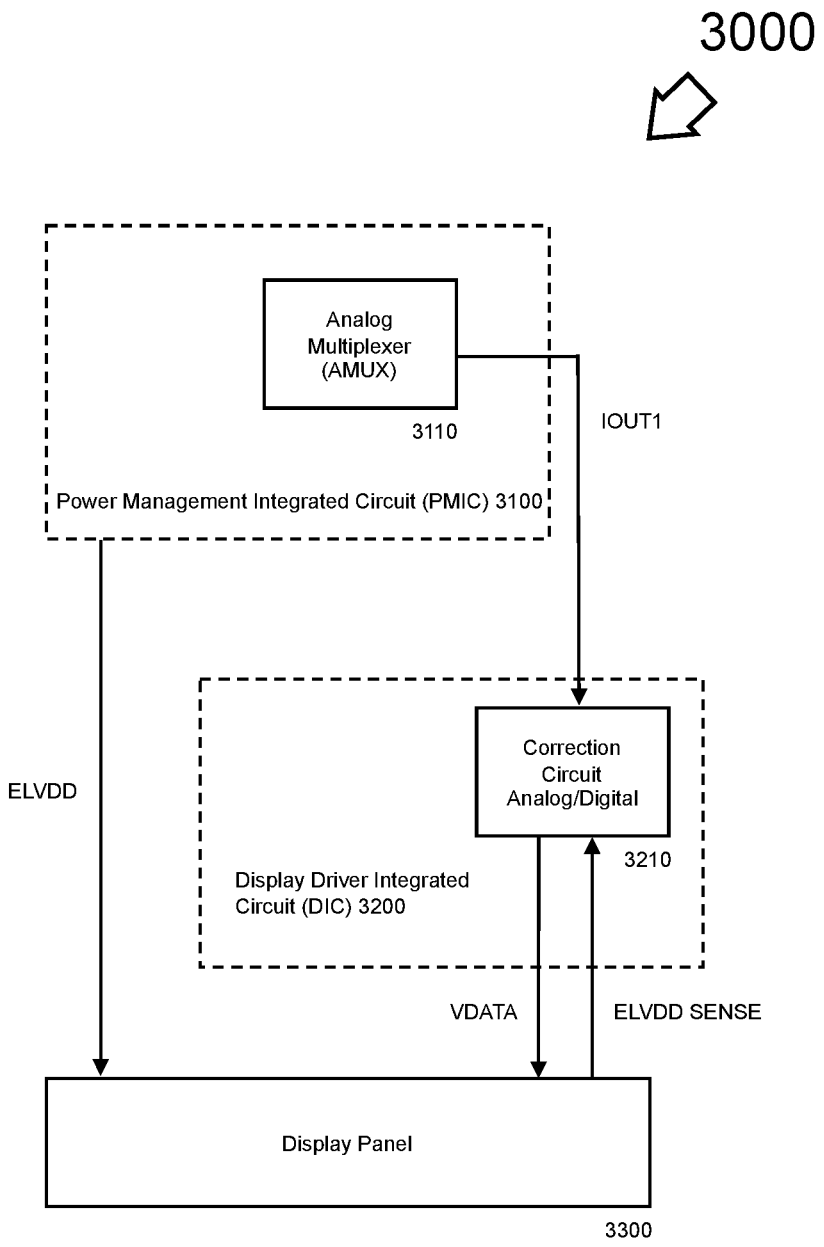
FIG. 3 is a block diagram of a flat-panel display of the present disclosure that implements the method depicted in FIG. 2.

FIG. 2 is a graph depicting a method 2000 of compensating for an electroluminescence voltage supply drop across the y-axis of the display panel. In such an embodiment, the pixel data voltage is corrected to mirror the ELVDD drop which results in consistent brightness and color by the flat-panel display. Turning to FIG. 3, a flat-panel display 3000 of the present disclosure implements the method 2000 depicted in FIG. 2.

Flat-panel display 3000 comprises a display panel 3300, a power management integrated circuit (PMIC) 3100, and a display driver integrated circuit (DIC) 3200.

The display panel 3300 may be an organic light-emitting diode (OLED) display, such as a passive-matrix (PMOLED) or active-matrix (AMOLED). In other embodiments, the display panel 3300 may be a liquid crystal display (LCD) or micro-light emitting diode (micro-LED) display. The display panel 3300 displays an image based upon the pixel display voltage and is powered by an electroluminescence voltage. As shown in FIG. 3, the pixel display voltage is received from the display driver integrated circuit (DIC) 3200, and the power management integrated circuit 3100 supplies the electroluminescence voltage.

The power management integrated circuit 3100 is an integrated circuit configured to manage power requirements of the flat-panel display 3000, and may perform electronic power conversion (such as dynamic voltage scaling) and/or power control functions. The power management integrated circuit 3100 is configured to supply an electroluminescence voltage to the display panel 3300. The power management integrated circuit 3100 may also comprise an analog multiplexer 3110 (AMUX) configured to supply an output current IOUT1 to the display driver integrated circuit 3200.

The display driver integrated circuit (DIC) 3200 is a semiconductor integrated circuit that provides an interface function between the display panel 3300 and a microprocessor, microcontroller, application specific integrated circuit or other general-purpose peripheral interface (not shown). In some embodiments, the display driver integrated circuit 3200 may alternatively comprise a state machine made of discrete logic and other components.

The display driver integrated circuit 3200 may incorporate Random Access Memory (RAM), flash memory, Electrically Erasable Programmable Read-Only Memory (EEPROM) and/or Read-Only Memory (ROM) (not shown). In some embodiments, display driver integrated circuit 3200 may include a frame buffer. The display driver integrated circuit 3200 includes a correction circuit 3210. The correction circuit 3210 is configured to correct the pixel data voltage (VDATA) to match the electroluminescence voltage drop, and may be either an analog or digital correction circuit. The correction circuit 3210 receives the output current IOUT1 from the analog multiplexor 3110. The correction circuit 3210 is also configured to sense the electroluminescence voltage (ELVDD SENSE) received by the display panel 3300. Using the output current IOUT and the sensed electroluminescence voltage ELVDD SENSE, the correction circuit 3210 is able to calculate the resistance of the panel, R_TRACE, using the relationship resistance=voltage/current. It is understood by one skilled in the art that the resistance of the panel R_TRACE governs the slope of the electroluminescence voltage ELVDD drop across the panel. This enables the correction circuit 3210 to correct the pixel data voltage VDATA by matching the electroluminescence voltage drop, thus maintaining the panel brightness and color uniformity.

Figure 6:
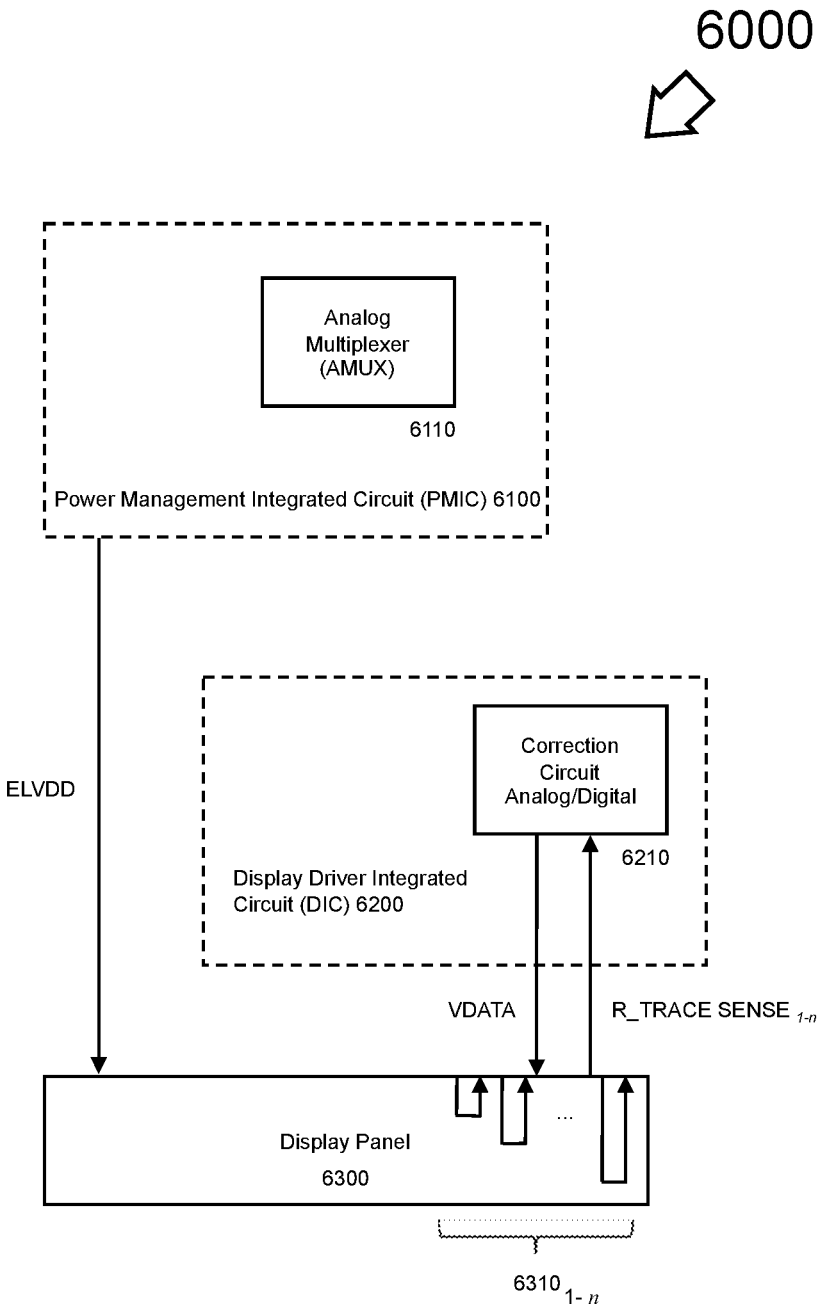
FIG. 6 is a block diagram of an alternate embodiment of a flat-panel display of the present disclosure that uses a plurality of sense rings embedded in a display panel to compensate for an electroluminescence voltage drop across a flat-panel display, by changing pixel data voltage to maintain the display brightness.

Instead of using a resistance of a display panel as a whole, in another embodiment a flat-panel display can compensate for an electroluminescence voltage supply drop by sensing the resistance from multiple locations across the display panel. FIG. 6 is a block diagram of a flat-panel display 6000 that compensates for an electroluminescence voltage supply drop across the y-axis of the display panel by sensing the resistance from multiple locations across the display panel starting and ending in a display driver integrated circuit 6200.

Flat-panel display 6000 comprises a display panel 6300, a power management integrated circuit (PMIC) 6100, and a display driver integrated circuit 6200.

The display panel 6300 may be an organic light-emitting diode (OLED) display, such as a passive-matrix (PMOLED) or active-matrix (AMOLED). The display panel 6300 displays an image based upon the pixel display voltage and is powered by an electroluminescence voltage. In this embodiment, sense rings $\mathbf{6310}_{1\text{-}n}$ are embedded within the display panel 6300 which allow the display driver integrated circuit 6200 to determine resistance of the panel, R_TRACE $\text{SENSE}_{1\text{-}n}$ at n locations across the display panel 6300, where n is an integer number greater than 1. It is understood by one skilled in the art that if n=1, that flat-panel display 6000 may be operationally similar to the flat-panel display 3000 embodiment. Each sense ring $\mathbf{6310}_{1\text{-}n}$ has a current sense; consequently, the resistance is determined using the relationship, resistance=voltage/current.

As shown in FIG. 6, the pixel display voltage is received from the display driver integrated circuit (DIC) 6200, and the power management integrated circuit 6100 supplies the electroluminescence voltage.

The power management integrated circuit 6100 is an integrated circuit configured to manage power requirements of the flat-panel display 6000, and may perform electronic power conversion (such as dynamic voltage scaling) and/or power control functions. The power management integrated circuit 6100 is configured to supply an electroluminescence voltage to the display panel 6300. The power management integrated circuit 6100 may also comprise an analog multiplexer 6110 (AMUX).

The display driver integrated circuit 6200 is a semiconductor integrated circuit that provides an interface function between the display panel 6300 and a microprocessor, microcontroller, application specific integrated circuit or other general-purpose peripheral interface (not shown). In some embodiments, the display driver integrated circuit 6200 may alternatively comprise a state machine made of discrete logic and other components.

The display driver integrated circuit 6200 may incorporate Random Access Memory (RAM), flash memory, Electrically Erasable Programmable Read-Only Memory (EEPROM) and/or Read-Only Memory (ROM) (not shown). In some embodiments, display driver integrated circuit 6200 may include a frame buffer. The display driver integrated circuit 6200 includes a correction circuit 6210. The correction circuit 6210 is configured to correct the pixel data voltage (VDATA) to match the electroluminescence voltage drop, and may be either an analog or digital correction circuit. The correction circuit 6210 receives the output current IOUT1 from the analog multiplexor 6110. The correction circuit 6210 is also configured to sense the resistance of the panel (R_TRACE $\text{SENSE}_{1\text{-}n}$) received by the display panel 6300. It is understood by one skilled in the art that the resistance of the panel R_TRACE governs the slope of the electroluminescence voltage ELVDD drop across the panel. This enables the correction circuit 6210 to correct the pixel data voltage VDATA to match the electroluminescence voltage drop, thus maintaining the panel brightness and color uniformity.

Figure 7:
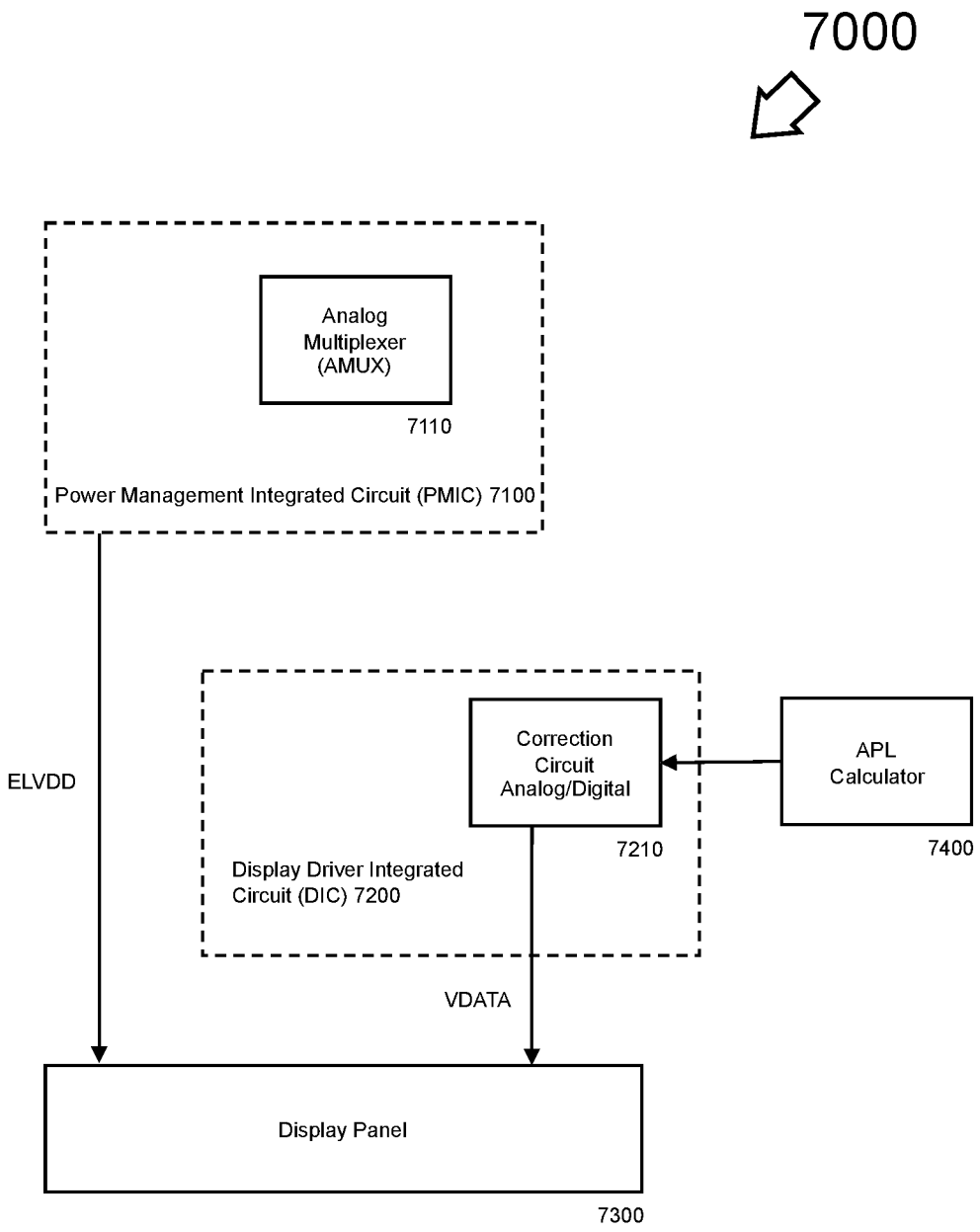
FIG. 7 is a block diagram of an alternate embodiment of a flat-panel display of the present disclosure that uses prior frame data to compensate for an electroluminescence voltage drop across a flat-panel display, by changing pixel data voltage to maintain the display brightness.

An image on the panel display is commonly referred to as a "frame." The alternate embodiment shown in FIG. 7 depicts a block diagram of a flat-panel display 7000 that uses currant and prior frame data to compensate for an electroluminescence voltage drop, by changing pixel data voltage to maintain the display brightness. In such an embodiment, the average pixel luminance (APL) is calculated between a currant image frame (Frame N), and a previous image frame (Frame N−1). The APL is provided to a correction circuit to allow the correction circuit to adjust the pixel data voltage VDATA to maintain the brightness (luminance) of the image.

As shown in FIG. 7, flat-panel display 7000 comprises a display panel 7300, a power management integrated circuit (PMIC) 7100, a display driver integrated circuit 7200, and an average pixel luminance calculator 7400.

The display panel 7300 may be an organic light-emitting diode (OLED) display, such as a passive-matrix (PMOLED) or active-matrix (AMOLED). The display panel 7300 displays an image based upon the pixel display voltage and is powered by an electroluminescence voltage. The pixel display voltage is received from the display driver integrated circuit (DIC) 6200, and the power management integrated circuit 6100 supplies the electroluminescence voltage.

The power management integrated circuit 7100 is an integrated circuit configured to manage power requirements of the flat-panel display 7000, and may perform electronic power conversion (such as dynamic voltage scaling) and/or power control functions. The power management integrated circuit 7100 is configured to supply an electroluminescence voltage to the display panel 7300.

Average pixel luminance calculator 7400 is a semiconductor integrated circuit that calculates the average pixel luminance of a current image frame (Frame N) and a previous image frame (Frame N−1). It is understood that the average pixel luminance calculator 7400 may operate in conjunction with a frame buffer, which may be internal or external to the average pixel luminance calculator 7400. When the frame buffer is external to the average pixel luminance calculator 7400, it may be contained as part of the display driver integrated circuit 7200. Once calculated, the average pixel luminance is provided to the display driver integrated circuit 7200. In some embodiments, the average pixel luminance calculator 7400 may receive the frame information from the display driver integrated circuit 7200.

The display driver integrated circuit 7200 is a semiconductor integrated circuit that provides an interface function between the display panel 7300 and a microprocessor, microcontroller, application specific integrated circuit or other general-purpose peripheral interface (not shown). In some embodiments, the display driver integrated circuit 7200 may alternatively comprise a state machine made of discrete logic and other components.

The display driver integrated circuit 7200 may incorporate Random Access Memory (RAM), flash memory, Electrically Erasable Programmable Read-Only Memory (EEPROM) and/or Read-Only Memory (ROM) (not shown). In some embodiments, display driver integrated circuit 7200 may include a frame buffer. The display driver integrated circuit 7200 includes a correction circuit 7210. The correction circuit 7210 is configured to receive average pixel luminance from the average pixel luminance calculator 7400 to correct the pixel data voltage (VDATA) to match the electroluminescence voltage drop, and may be either an analog or digital correction circuit.

Figure 4:
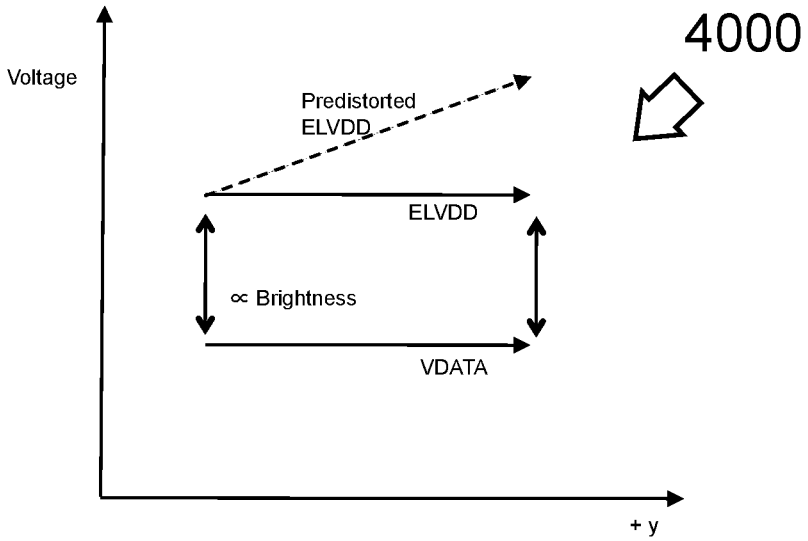
FIG. 4 illustrates a method of compensating for an electroluminescence voltage drop across a flat-panel display, by predistorting the electroluminescence voltage to maintain the display brightness.

An alternate method of compensating for an electroluminescence voltage drop across a flat-panel display is by predistorting the electroluminescence voltage to maintain the display brightness. As shown in FIG. 4, when a predistorted the electroluminescence voltage (shown as a dotted line) is transmitted across the y-axis of the flat-panel display, the actual resulting electroluminescence voltage (ELVDD) remains constant—which helps maintain the display brightness and prevent color distortion.

Figure 5:
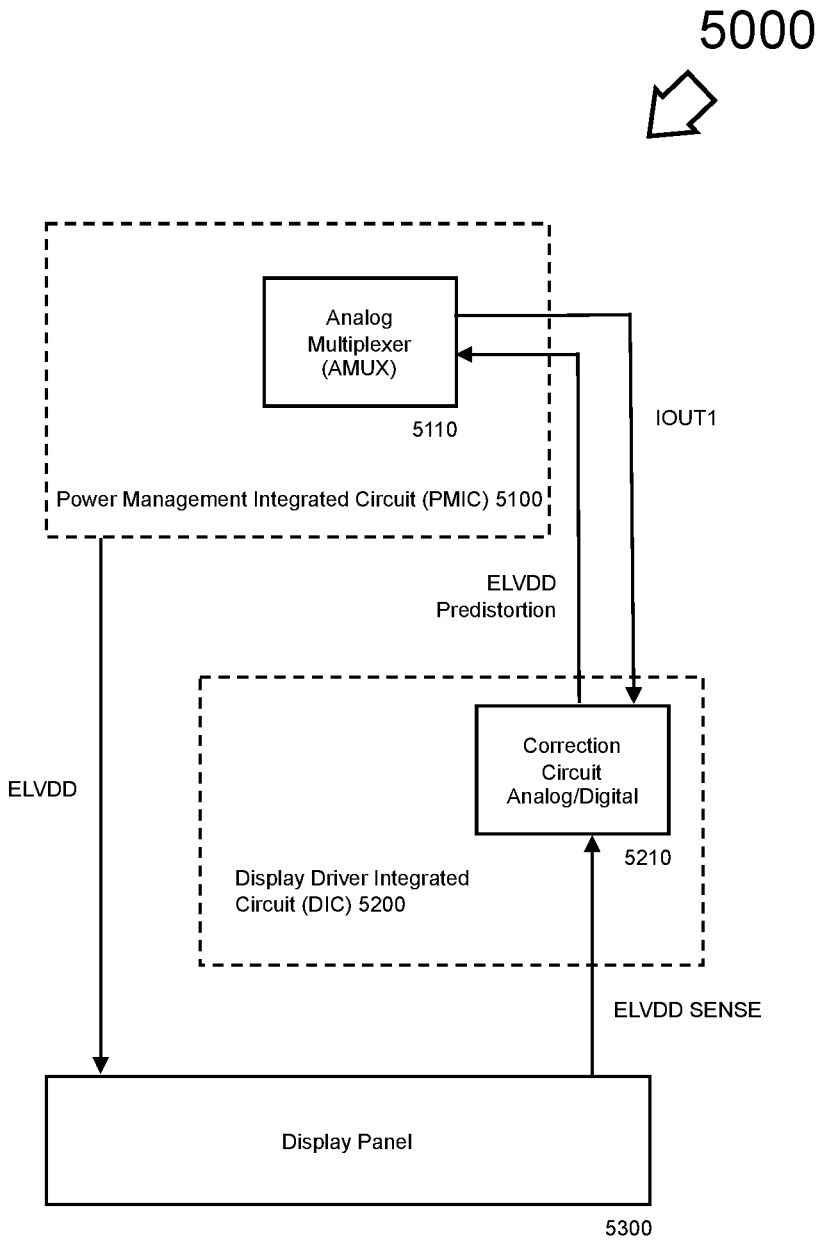
FIG. 5 is a block diagram of a flat-panel display of the present disclosure that implements the method depicted in FIG. 4.

FIG. 5 is a block diagram of a flat-panel display 5000 of the present disclosure that implements the method 4000 depicted in FIG. 4.

Flat-panel display 5000 comprises a display panel 5300, a power management integrated circuit (PMIC) 5100, and a display driver integrated circuit 5200.

The display panel 5300 may be an organic light-emitting diode (OLED) display, such as a passive-matrix (PMOLED) or active-matrix (AMOLED). The display panel 5300 displays an image based upon the pixel display voltage and is powered by an electroluminescence voltage. As shown in FIG. 5, the power management integrated circuit 5100 supplies the display panel 5300 an electroluminescence voltage ELVDD.

The power management integrated circuit 5100 is an integrated circuit configured to manage power requirements of the flat-panel display 5000, and may perform electronic power conversion (such as dynamic voltage scaling) and/or power control functions. The power management integrated circuit 5100 is configured to supply the electroluminescence voltage to the display panel 5300. The power management integrated circuit 5100 may also comprise an analog multiplexer 5110 (AMUX) configured to supply an output current IOUT1 to the display driver integrated circuit 5200 and receive a predistorted electroluminescence data (ELVDD Predistortion) from the same. Predistorted electroluminescence data is data instructing the power management integrated circuit 5100 on output electroluminescence voltage ELVDD to be output to the display panel 5300 in order to effectively maintain a steady actual electroluminescence voltage.

The display driver integrated circuit (DIC) 5200 is a semiconductor integrated circuit that provides an interface function between the display panel 5300 and a microprocessor, microcontroller, application specific integrated circuit or other general-purpose peripheral interface (not shown). In some embodiments, the display driver integrated circuit 5200 may alternatively comprise a state machine made of discrete logic and other components.

The display driver integrated circuit 5200 may incorporate Random Access Memory (RAM), flash memory, Electrically Erasable Programmable Read-Only Memory (EEPROM) and/or Read-Only Memory (ROM) (not shown). In some embodiments, display driver integrated circuit 5200 may include a frame buffer. The display driver integrated circuit 5200 includes a correction circuit 5210. The correction circuit 5210 may be either an analog or digital correction circuit. The correction circuit 5210 is configured to correct provide the power management integrated circuit 5100 predistorted electroluminescence data to match the expected electroluminescence voltage drop. The correction circuit 5210 receives the output current IOUT1 from the analog multiplexor 5110. The correction circuit 5210 is also configured to sense the electroluminescence voltage (ELVDD SENSE) received by the display panel 5300. Using the output current IOUT and the sensed electroluminescence voltage ELVDD SENSE, the correction circuit 5210 is able to calculate the resistance of the panel, R_TRACE, using the relationship resistance=voltage/current. It is understood by one skilled in the art that the resistance of the panel R_TRACE governs the slope of the electroluminescence voltage ELVDD drop across the panel. This enables the correction circuit 5210 to correct the ELVDD Predistortion data to match the electroluminescence voltage drop, thus maintaining the panel brightness and color uniformity.

It is understood by those familiar with the art that the system described herein may be implemented in a variety of hardware or firmware solutions.

The previous description of the embodiments is provided to enable any person skilled in the art to practice the disclosure. The various modifications to these embodiments will be readily apparent to those skilled in the art, and the generic principles defined herein may be applied to other embodiments without the use of inventive faculty. Thus, the present disclosure is not intended to be limited to the embodiments shown herein, but is to be accorded the widest scope consistent with the principles and novel features disclosed herein.

What is claimed is:

1. An electronic display comprising:

a display panel configured to receive a display voltage;

a power management integrated circuit (PMIC) configured to supply an electroluminescence voltage to the display panel; and a display driver integrated circuit with a correction circuit, the correction circuit configured to sense the electroluminescence voltage supplied to the display panel, to calculate voltage drop from the electroluminescence voltage and an expected supply voltage, and to correct the display voltage to match the voltage drop;

wherein the power management integrated circuit further comprises an analog multiplexer configured to output an output current to the correction circuit.

2. The electronic display of claim 1, wherein the correction circuit uses the output current and the voltage drop from the electroluminescence voltage to calculate a resistance of the panel; and the correction circuit uses the resistance of the panel to correct the display voltage to match the voltage drop.

3. The electronic display of claim 2, wherein the display panel is a light-emitting diode (LED) or liquid crystal display (LCD) display.

4. The electronic display of claim 2, wherein the display panel is an organic light-emitting diode (OLED) display.

5. The electronic display of claim 1, the display panel further comprises:

a plurality of sense rings embedded within the display panel, each of the sense rings configured to provide a resistance measurement at a plurality of locations across the display panel, and to provide the resistance measurement to the correction circuit.

6. The electronic display of claim 5, where the correction circuit is configured to receive the resistance measurement from each of the sense rings and to calculate the voltage drop from the electroluminescence voltage and an expected supply voltage from the resistance measurement from each of the sense rings to match the voltage drop at the plurality of locations across the display panel.

7. The electronic display of claim 6, wherein the display panel is a light-emitting diode (LED) or liquid crystal display (LCD) display.

8. The electronic display of claim 6, wherein the display panel is an organic light-emitting diode (OLED) display.

9. An electronic display comprising:

a display panel configured to receive a display voltage;

a display driver integrated circuit with a correction circuit, the correction circuit configured to sense an electroluminescence voltage supplied to the display panel, to calculate voltage drop from the electroluminescence voltage and an expected supply voltage, and to calculate an electroluminescence voltage distortion based on the voltage drop; and a power management integrated circuit (PMIC) configured to receive the electroluminescence voltage distortion from the display driver integrated circuit and to supply a predistorted electroluminescence voltage to the display panel based on the electroluminescence voltage distortion, the power management integrated circuit further comprising an analog multiplexer configured to output an output current to the correction circuit.

10. The electronic display of claim 9, wherein the correction circuit uses the output current and the voltage drop from the electroluminescence voltage to calculate a resistance of the panel; and the correction circuit uses the resistance of the panel to correct the display voltage to supply a predistorted electroluminescence voltage to the display panel based on the electroluminescence voltage distortion.

11. The electronic display of claim 10, wherein the display panel is a light-emitting diode (LED) or liquid crystal display (LCD) display.

12. The electronic display of claim 10, wherein the display panel is an organic light-emitting diode (OLED) display.

13. An electronic display comprising:

a display panel configured to receive a display voltage;

a power management integrated circuit (PMIC) configured to supply an electroluminescence voltage to the display panel;

a calculator configured to calculate an average pixel luminance of a current image frame supplied to the display panel and a previous image frame supplied to the display panel; and a display driver integrated circuit with a correction circuit, the correction circuit configured to receive the average pixel luminance from the average luminance calculator, and to correct the display voltage based on the average pixel luminance.

14. The electronic display of claim 13, wherein the current image frame supplied to the display panel and the previous image frame supplied to the display panel are stored in a frame buffer.

15. The electronic display of claim 14, wherein the average pixel luminance calculator receives the current image frame and the previous image frame from the frame buffer.

16. The electronic display of claim 14, wherein the frame buffer is contained within the average pixel luminance calculator or the display driver integrated circuit.

17. The electronic display of claim 16, wherein the display panel is a light-emitting diode (LED) or liquid crystal display (LCD) display.

18. The electronic display of claim 16, wherein the display panel is an organic light-emitting diode (OLED) display.

19. The electronic display of claim 18, wherein the organic light-emitting diode display is an active-matrix organic light-emitting diode (AMOLED) display.

20. The electronic display of claim 18, wherein the organic light-emitting diode display is a passive-matrix organic light-emitting diode (PMOLED) display.

* * * * *